US008177325B2

(12) United States Patent
Kim et al.

(10) Patent No.: US 8,177,325 B2
(45) Date of Patent: May 15, 2012

(54) INKJET IMAGE FORMING APPARATUS

(75) Inventors: Young Choon Kim, Seoul (KR); Karp Sik Youn, Hwasung-si (KR); Dong Woo Ha, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 432 days.

(21) Appl. No.: 12/437,569

(22) Filed: May 8, 2009

(65) Prior Publication Data

US 2010/0002046 A1 Jan. 7, 2010

(30) Foreign Application Priority Data

Jul. 2, 2008 (KR) ..... 2008-63950

(51) Int. Cl.
*B41J 2/165* (2006.01)

(52) U.S. Cl. ..... 347/33

(58) Field of Classification Search ..... 347/32, 347/33, 34, 81
See application file for complete search history.

(56) References Cited

U.S. PATENT DOCUMENTS

2006/0092211 A1* 5/2006 Arakawa et al. ..... 347/19
2008/0225067 A1* 9/2008 Morino et al. ..... 347/14

FOREIGN PATENT DOCUMENTS

JP 09-094947 4/1997

* cited by examiner

*Primary Examiner* — Stephen Meier
*Assistant Examiner* — Tracey McMillion
(74) *Attorney, Agent, or Firm* — Stanzione & Kim, LLP

(57) ABSTRACT

An inkjet image forming apparatus includes a device to protect an ink sensing device operated without use of a separate drive source. The inkjet image forming apparatus includes at least one protecting device having a protecting member to protect the ink sensing device from impurities or to release the ink sensing device from protection, the protecting member being operated in linkage with the maintenance device to thereby be moved between the first position and the second position.

26 Claims, 11 Drawing Sheets

INKJET IMAGE FORMING APPARATUS

CROSS-REFERENCE TO RELATED APPLICATIONS

This application claims priority under 35 U.S.C. §119(a) from Korean Patent Application No. 2008-0063950, filed on Jul. 2, 2008 in the Korean Intellectual Property Office, the disclosure of which is incorporated herein in its entirety by reference.

BACKGROUND OF THE INVENTION

1. Field of the Invention

The present general inventive concept relates to an inkjet image forming apparatus, and, more particularly, to an inkjet image forming apparatus having an ink sensing device to sense ejection of ink.

2. Description of the Related Art

An image forming apparatus is an apparatus to form an image on a printing medium according to input image signals. Examples of the image forming apparatus include printers, copiers, facsimiles, devices combining functions thereof, and the like.

Image forming apparatuses may be classified, according to a printing method thereof, into electro-photographic image forming apparatuses and inkjet image forming apparatuses. Of these, inkjet image forming apparatuses print an image by ejecting fine droplets of ink to a printing medium at desired positions.

A conventional inkjet image forming apparatus includes an inkjet head provided with a plurality of nozzles. A high quality image can be printed on a printing medium when droplets of ink are normally ejected from the nozzles of the inkjet head. However, occasionally, some of the nozzles may exhibit ejection failure, causing deterioration of print quality.

Stabilizing the print quality of the inkjet image forming apparatus requires a mechanism to restore a defective nozzle or compensate for print failure due to the defective nozzle. To realize the mechanism, a process to specify a position of the defective nozzle must be performed.

To specify the position of the defective nozzle, the inkjet image forming apparatus may be provided with an ink sensing device. The ink sensing device ascertains whether or not the nozzles of the inkjet head normally eject ink, thereby detecting a presence of a defective nozzle.

The ink sensing device has a likelihood of being contaminated by ink scattered from the inkjet head during a printing operation or maintenance operation, or dust scattered from a printing medium being transferred. The contaminated ink sensing device may exhibit deteriorated operational ability, or may completely cease to function.

SUMMARY OF THE INVENTION

The present general inventive concept provides an inkjet image forming apparatus in which an ink sensing device can be protected from contaminants.

The present general inventive concept also provides an inkjet image forming apparatus in which a device to protect an ink sensing device can be operated without relying on a separate drive source.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing an inkjet image forming apparatus including an inkjet head having a nozzle portion formed with ink ejecting nozzles, an ink sensing device to sense ink ejected from the nozzles, a maintenance device to perform an operation of maintaining the nozzle portion in a normal condition, and at least one protecting device having a protecting member to protect the ink sensing device from impurities at a first position and to release the ink sensing device from protection at a second position, the protecting member being operated in linkage with the maintenance device to thereby be moved between the first position and the second position.

The maintenance device may include a wiping unit to be moved below the nozzle portion in a direction crossing the nozzle portion, so as to wipe the nozzle portion.

The protecting member may be operated in linkage with the wiping unit, to thereby be moved between the first position and the second position.

The maintenance device may include a carriage to be moved along the nozzle portion below the nozzle portion.

The protecting member may be operated in linkage with the carriage, to thereby be moved between the first position and the second position.

The maintenance device may include a wiping unit to be moved below the nozzle portion in a direction crossing the nozzle portion so as to wipe the nozzle portion, and a carriage to be moved along the nozzle portion below the nozzle portion, the carriage incorporating a cleaning unit to clean the nozzle portion.

The at least one protecting device may include a first protecting device to be operated in linkage with the wiping unit, and a second protecting device to be operated in linkage with the carriage.

The inkjet image forming apparatus may further include a platen having a printing position where the platen opposes the nozzle portion and supports a printing medium, and a maintenance position where the platen is moved from the printing position to expose the bottom of the nozzle portion.

The maintenance device may be operated in linkage with the platen, and the protecting device may be operated in linkage with the maintenance device.

The protecting member may include a first pivot shaft, and a shutter and an operating arm extending in different directions from the first pivot shaft, the operating arm may be operated in linkage with the wiping unit according to a position of the wiping unit, so as to rotate the first pivot shaft, and the shutter may be moved between the first position and the second position according to rotation of the first pivot shaft.

The protecting device may further include a lever disposed between the wiping unit and the protecting member, and the lever may include a lever pivot shaft, a first lever arm extending from the lever pivot shaft toward the wiping unit and having one end located at a position to be interfered with the wiping unit, and a second lever arm extending from the lever pivot shaft toward the protecting member and having one end located at a position to be interfered with the operating arm of the protecting member.

The maintenance device may further include a maintenance frame having a guide-way to guide movement of the wiping unit, the wiping unit may include a guide protrusion to be inserted into the guide-way, and the one end of the first lever arm may be disposed in the guide-way so as to be interfered with the guide protrusion.

The protecting member may include a second pivot shaft, an extending arm extending from the second pivot shaft and located at a position to be interfered with the carriage, and a shutter provided at an end of the extending arm, the extending arm may be interfered with the carriage according to a position of the carriage, so as to rotate the second pivot shaft, and the shutter may be moved between the first position and the second position according to rotation of the second pivot shaft.

The ink sensing device may include a light emitting unit to emit light to a region below the nozzle portion, and a light receiving unit to receive the light having passed through the region below the nozzle portion, and the at least one protecting device may include a first protecting device corresponding to the light emitting unit, and a second protecting device corresponding to the light receiving unit.

The foregoing and/or other aspects and utilities of the general inventive concept may also be achieved by providing an inkjet image forming apparatus including an inkjet head including a nozzle portion having a length at least greater than a width of a printable printing medium, a light emitting unit having a light emitting element to emit light to an ink ejecting region provided below the nozzle portion, a light receiving unit having a light receiving element to receive the light having passed through the ink ejecting region, a maintenance device to perform an operation of maintaining the nozzle portion in a normal condition while being moved between a first ready position and a second ready position, and a first protecting device having a first protecting member disposed to shield one of the light emitting element and the light receiving element from the ink ejecting region, wherein the first protecting member is operated in linkage with movement of the maintenance device, so as to expose the one of the light emitting element and the light receiving element to the ink ejecting region.

The maintenance device may include a wiping unit to be moved below the nozzle portion in a direction crossing the nozzle portion, so as to wipe the nozzle portion.

The first protecting member may expose the one of the light emitting element and the light receiving element to the ink ejecting region when the wiping unit is at the first ready position.

The first protecting member may include a first pivot shaft, an operating arm connected to the first pivot shaft and operated in linkage with the wiping unit, and a shutter connected to the first pivot shaft and used to shield or expose the one of the light emitting element and the light receiving element according to movement of the operating arm.

The first protecting device may further include a lever disposed between the wiping unit and the first protecting member, the lever being operated in linkage with the wiping unit so as to move the first protecting member.

The inkjet image forming apparatus may further include a second protecting device having a second protecting member disposed to shield the other one of the light emitting element and the light receiving element from the ink ejecting region, wherein the maintenance device further includes a carriage to be movable in a longitudinal direction of the nozzle portion, and the second protecting member is operated in linkage with the carriage, so as to expose the other one of the light emitting element and the light receiving element to the ink ejecting region.

The second protecting member may include a second pivot shaft, an extending arm extending from the second pivot shaft and located at a position to be interfered with the carriage, and a shutter to shield or expose the other one of the light emitting element and the light receiving element according to movement of the extending arm.

The carriage may include a guide-way to guide movement of the wiping unit.

The second protecting member may expose the other one of the light emitting element and the light receiving element to the ink ejecting region as the carriage is moved away from the second protecting member after guiding the wiping unit.

A cleaning unit to clean the nozzle portion may be mounted in the carriage.

The foregoing and/or other aspects and utilities of the general inventive concept may also be achieved by providing an inkjet image forming apparatus including an inkjet head including a nozzle portion having a length at least greater than a width of a printable printing medium, a light emitting unit having a light emitting element to emit light to an ink ejecting region provided below the nozzle portion, a light receiving unit having a light receiving element to receive the light having passed through the ink ejecting region, a first maintenance unit be moved below the nozzle portion in a direction crossing the nozzle portion, so as to perform a maintenance operation for the nozzle portion, a carriage disposed to be movable in a longitudinal direction of the nozzle portion and incorporating a second maintenance unit to perform a maintenance operation for the nozzle portion, a first shutter to be operated in linkage with movement of the first maintenance unit, so as to shield or expose one of the light emitting element and the light receiving element from or to the ink ejecting region, and a second shutter to be operated in linkage with movement of the carriage, so as to shield or expose the other one of the light emitting element and the light receiving element from or to the ink ejecting region.

The foregoing and/or other aspects and utilities of the general inventive concept may also be achieved by providing an inkjet image forming apparatus including an inkjet head to eject ink, a maintenance device to maintain the inkjet head to eject the ink in a maintenance position, an ink sensing device to sense ink ejected from the inkjet head, one or more protecting devices to protect the ink sensing device from contaminants in a protecting position, and a linkage coupled to the maintenance device and the one or more protecting devices, and to move the maintenance device to the maintenance position and the one or more protecting devices to the protecting position.

The one or more protecting devices may include a pivot shaft, a lever to transmit power to the pivot shaft, a shutter extending from the pivot shaft to inner ends of the ink sensing device, and an operating arm extending from the pivot shaft toward the lever.

The inkjet image forming apparatus may further include a platen to move between a printing position and a non-printing position, wherein the linkage moves according to a movement of the platen to control a movement of at least one of the maintenance device and the protecting devices.

BRIEF DESCRIPTION OF THE DRAWINGS

These and/or other aspects and utilities of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
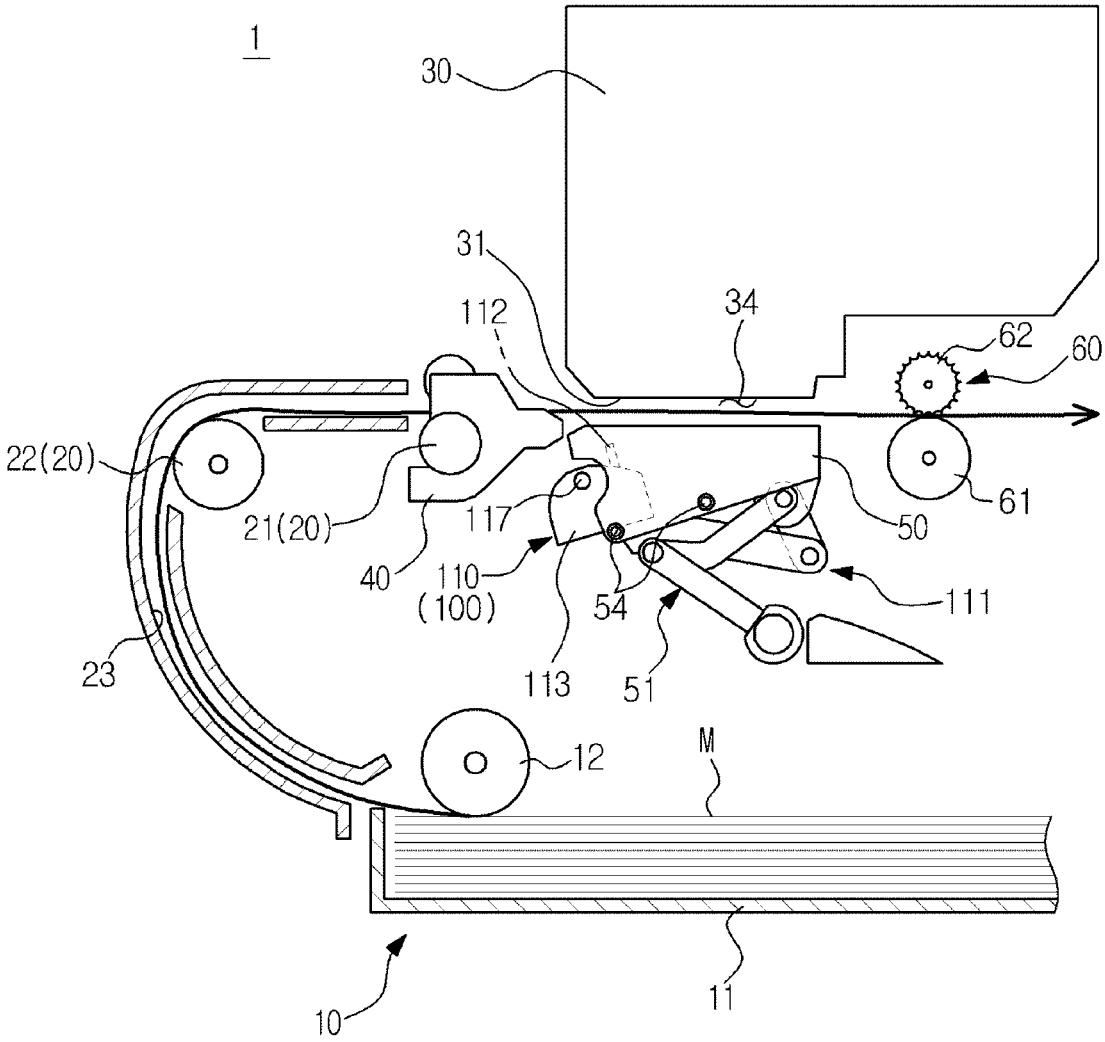
FIG. 1 is a view illustrating an inkjet image forming apparatus in accordance with an embodiment of the present general inventive concept, in a state wherein a platen is at a printing position.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

Figure 2:
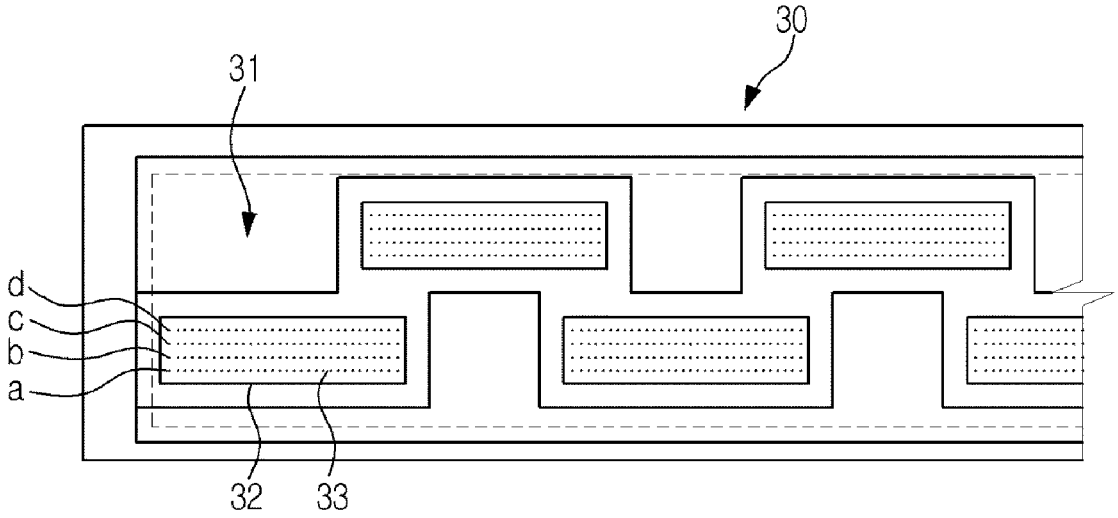
FIG. 2 is a view illustrating a nozzle portion of an inkjet head provided in the inkjet image forming apparatus of FIG. 1.
Figure 3:
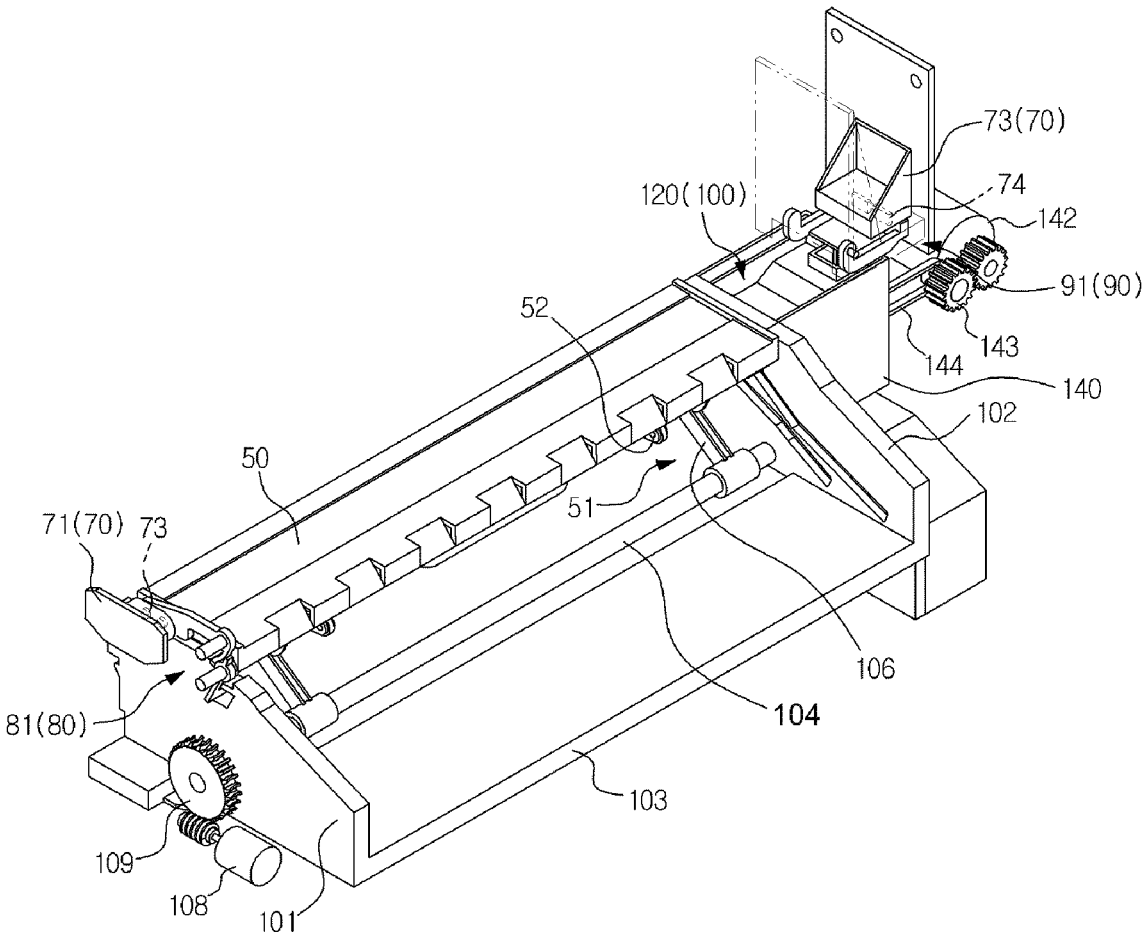
FIG. 3 is a perspective view illustrating the inkjet image forming apparatus of FIG. 1, in a state wherein a platen is at the printing position.
Figure 4:
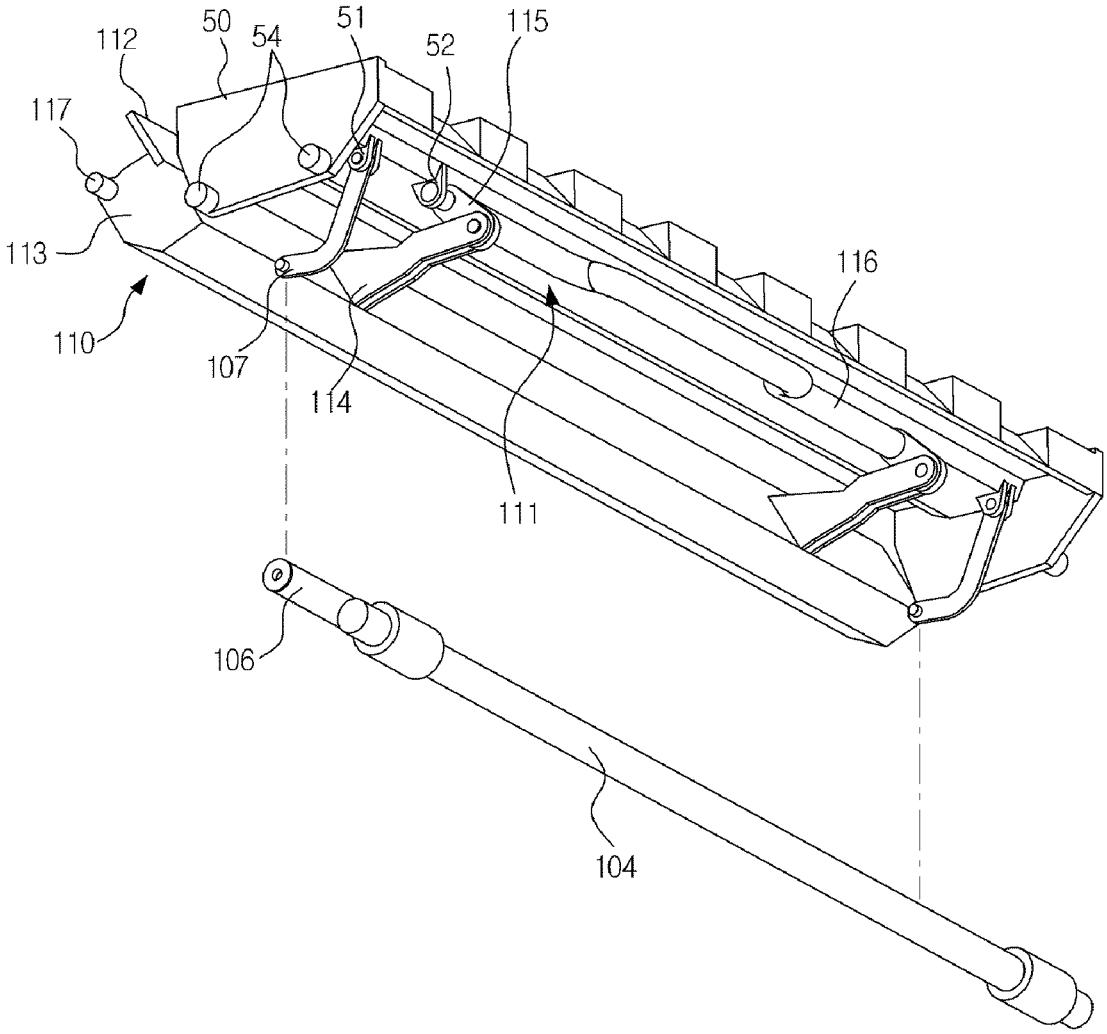
FIG. 4 is a bottom perspective view illustrating a coupling relationship of a platen and a wiping unit provided in the inkjet image forming apparatus in accordance with the embodiment of the present general inventive concept.
Figure 5:
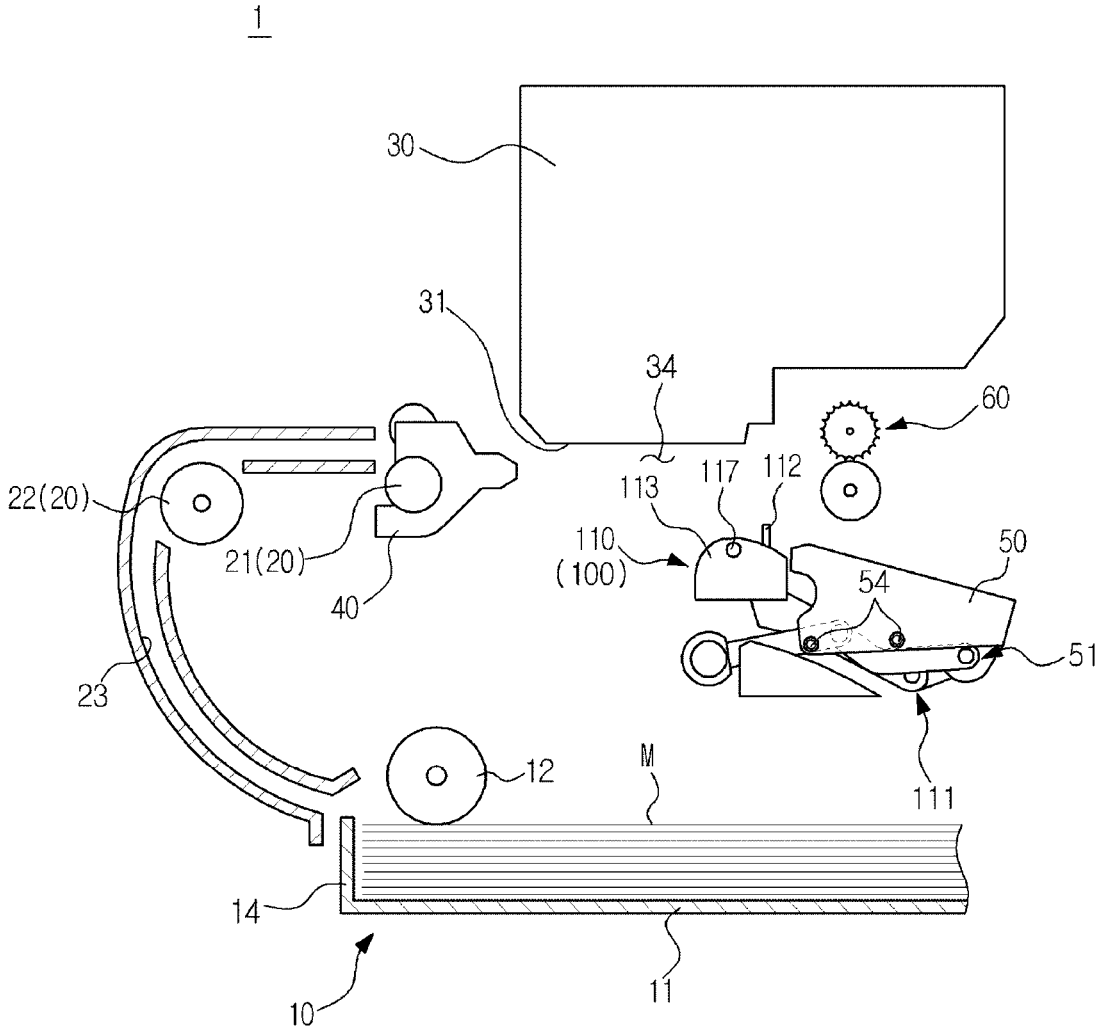
FIG. 5 is a view illustrating the inkjet image forming apparatus in accordance with an embodiment of the present general inventive concept, in a state wherein a platen is at a maintenance position.
Figure 6:
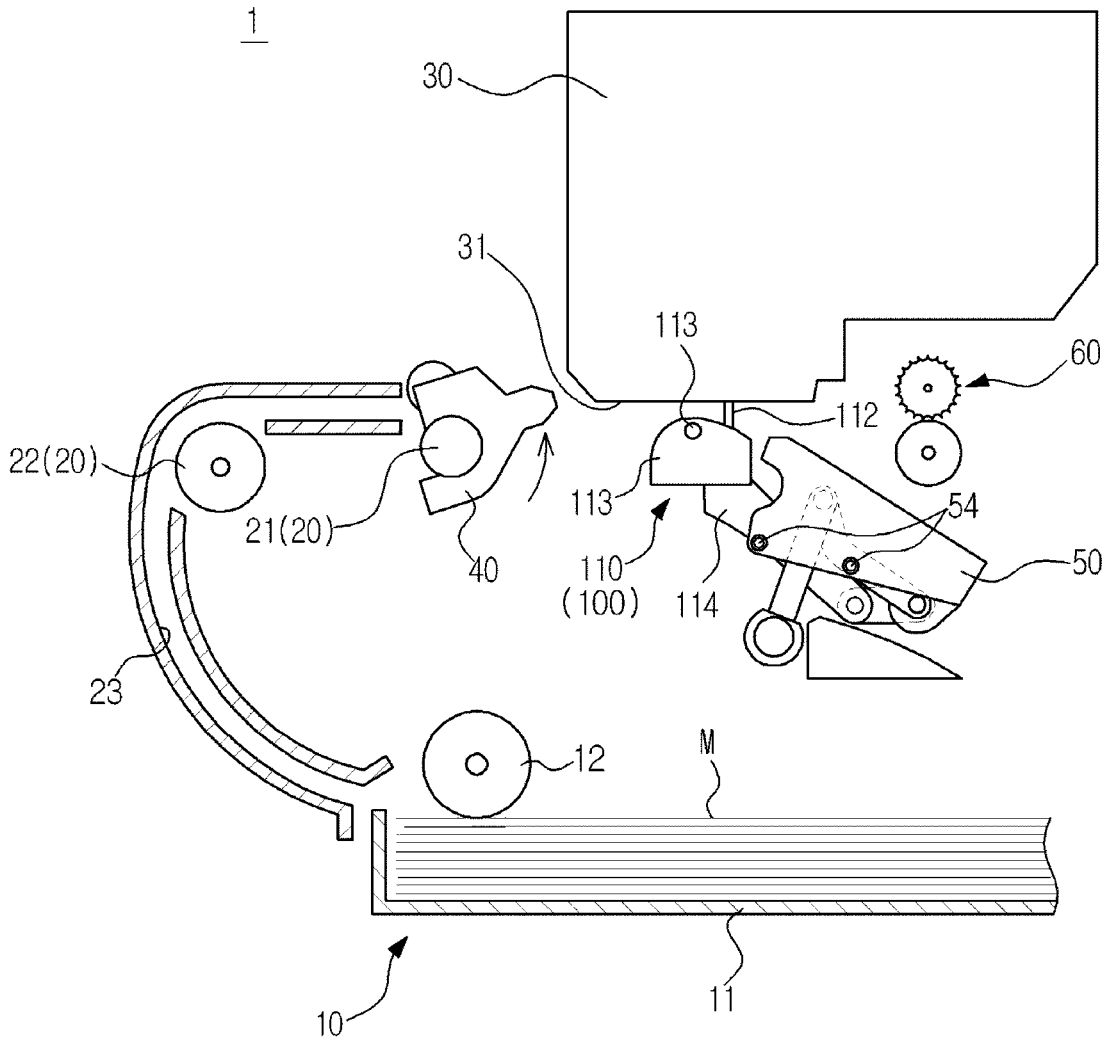
FIG. 6 is a view illustrating the inkjet image forming apparatus in accordance with an embodiment of the present general inventive concept, in a state wherein a wiping unit is performing a wiping operation.

FIG. 1 is a view illustrating an inkjet image forming apparatus in accordance with an embodiment of the present general inventive concept, in a state wherein a platen is at a printing position. FIG. 2 is a view illustrating a nozzle portion of an inkjet head provided in the inkjet image forming apparatus of FIG. 1. FIG. 3 is a perspective view illustrating the inkjet image forming apparatus of FIG. 1, in a state wherein the platen is at the printing position. FIG. 4 is a bottom perspective view illustrating a coupling relationship of the platen and a wiping unit provided in the inkjet image forming apparatus in accordance with an embodiment of the present general inventive concept. FIG. 5 is a view illustrating the inkjet image forming apparatus in accordance with an embodiment of the present general inventive concept, in a state wherein the platen is at a maintenance position. Also, FIG. 6 is a view illustrating the inkjet image forming apparatus in accordance with an embodiment of the present general inventive concept, in a state wherein a wiping unit is performing a wiping operation.

As illustrated in FIGS. 1 to 6, the inkjet image forming apparatus 1 in accordance with the embodiments of the present general inventive concept includes a printing medium feeding device 10, a delivery device 20, an inkjet head 30, a platen 50, and a printing medium discharge device 60.

The printing medium feeding device 10 is configured to store printing media M therein and feeds the stored printing media M to a delivery path 23. The printing medium feeding device 10 includes a tray 11 in which the printing media M is loaded, and a pickup roller 12 to pick up the printing media M loaded in the tray 11 sheet by sheet.

The delivery device 20 serves to deliver each printing medium M picked by the pickup roller 12 to below the inkjet head 30. The delivery device 20 includes a feeding roller 21 provided near an entrance of the inkjet head 30 and an auxiliary roller 22 provided between the feeding roller 21 and the pickup roller 12.

The inkjet head 30 includes a nozzle portion provided with ink ejecting nozzles. In the present embodiment, the inkjet head 30 is an array type inkjet head in which a nozzle portion has a length at least greater than a width of the printing medium M. The array type inkjet head 30 ejects, at a fixed position thereof, ink onto the printing medium M being transferred, thereby printing an image on the printing medium M.

Although FIG. 2 illustrates an example in which the nozzle portion of the inkjet head 30 has a length corresponding to a width of a specific-size printing medium (for example, A4 sheet), alternatively, the inkjet head may include a plurality of nozzle portions each having a length half or one-third the width of the printing medium.

As illustrated in FIG. 2, the nozzle portion 31 includes a plurality of nozzle plates 32 arranged in a zigzag pattern in a width direction of the nozzle portion 31. Each nozzle plate 32 is formed with a plurality of ink ejecting nozzles 33. The nozzle plate 32 may be defined with a plurality of nozzle rows a, b, c and d, to eject the same color or different colors of ink (for example, cyan, magenta, yellow and black), respectively.

The platen 50 (FIG. 1) is located below the nozzle portion 31 of the inkjet head 30, to support the printing medium M being transferred. FIG. 1 illustrates a printing position where the platen 50 is located below the inkjet head 30 to support the printing medium M. A printing medium guide 40 may be provided downstream of the platen 50 in a delivery direction of the printing medium M, to guide the printing medium M below the inkjet head 30.

The printing medium discharge device 60 is provided upstream of the platen 50, to discharge the printing medium M to the outside of the image forming apparatus 1. The printing medium discharge device 60 may include a discharge roller 61, and a star-wheel 62 disposed opposite the discharge roller 61. The star-wheel 62 serves not only to prevent the printing medium M from coming into contact with the nozzle portion 31 while passing below the nozzle portion 31, but also to prevent a variation in distance between the printing medium M and the nozzle portion 31.

Once the printing medium M loaded in the tray 11 is picked up by the pickup roller 12 upon initiation of a printing operation, the printing medium M is delivered by the auxiliary roller 22 and the feeding roller 21 and is guided by the printing medium guide 40 to below the inkjet head 30. While the printing medium M below the inkjet head 30 is supported by the platen 50, the nozzle portion 31 of the inkjet head 30 ejects ink, printing an image on the printing medium M.

In the above-described printing operation, if some of the nozzles 33 have malfunction, ink ejection failure may occur, resulting in print failure. Accordingly, maintaining good print quality to ascertain the presence of a defective nozzle and a position of the defective nozzle is important.

Ink droplets around the nozzle portion 31 may be solidified while the inkjet image forming apparatus 1 does not perform a printing operation and that impurities such as fine dust, etc., may be attached to the nozzle portion 31. The solidified ink or impurities distort an ink ejection direction during a printing operation, causing deterioration of print quality or clogging of the nozzles 33, resulting in print failure. Therefore, there is a need for a maintenance operation to maintain the nozzles 33 of the inkjet head 30 in a normal condition while the image forming apparatus 1 does not perform a printing operation.

As illustrated in FIGS. 1 to 3, the inkjet image forming apparatus 1 in accordance with the embodiment of the present general inventive concept further includes an ink sensing device 70, and a maintenance device 100. The ink sensing device 70 ascertains whether the nozzles 33 of the inkjet head 30 normally eject ink, thereby detecting the presence of a defective nozzle. The maintenance device 100 performs an operation to maintain the nozzles 31 of the inkjet head 30 in a normal condition.

To ascertain the condition of each nozzle 33, the ink sensing device 70 optically detects ink droplets ejected from the respective nozzles 33 of the inkjet head 30 as illustrated in FIG. 2. The ink sensing device 70 includes a light emitting unit 71 and a light receiving unit 73, which are arranged opposite each other with respect to the inkjet head 30 interposed therebetween. The light emitting unit 71 is disposed outside a first sidewall 101 of a maintenance frame 103, and the light receiving unit 73 is disposed outside a second sidewall 102 of the maintenance frame 103. Light, emitted from the light emitting unit 71, passes through below the inkjet head 30 (i.e. an ink ejecting region 34 or a printing region), to thereby be detected by the light receiving unit 73. As ink droplets ejected from the nozzles 33 of the inkjet head 30 intercept the light, varying light quantity, detected by the light receiving unit 73. Accordingly, monitoring a variation of light quantity detected by the light receiving unit 73 can ascertain whether the respective nozzles 33 of the inkjet head 30 normally eject ink droplets.

Although the above-described optical detection easily detects a defective nozzle using a relatively simple device, the light emitting unit 71 and the light receiving unit 73 are arranged below the nozzles 33 and therefore, light emitting elements 72 and light receiving elements 74 of the light emitting unit 71 and the light receiving unit 73 are exposed to the ink ejecting region. This has a high likelihood of the light emitting elements 72 and the light receiving elements 74 being contaminated by ink scattered during a printing operation or being contaminated by paper dust. Contamination of the light emitting elements 72 and the light receiving elements 74 deteriorates reliability of the ink sensing device 70 and in the worst case, ceases function of the ink sensing device 70.

Figure 8:
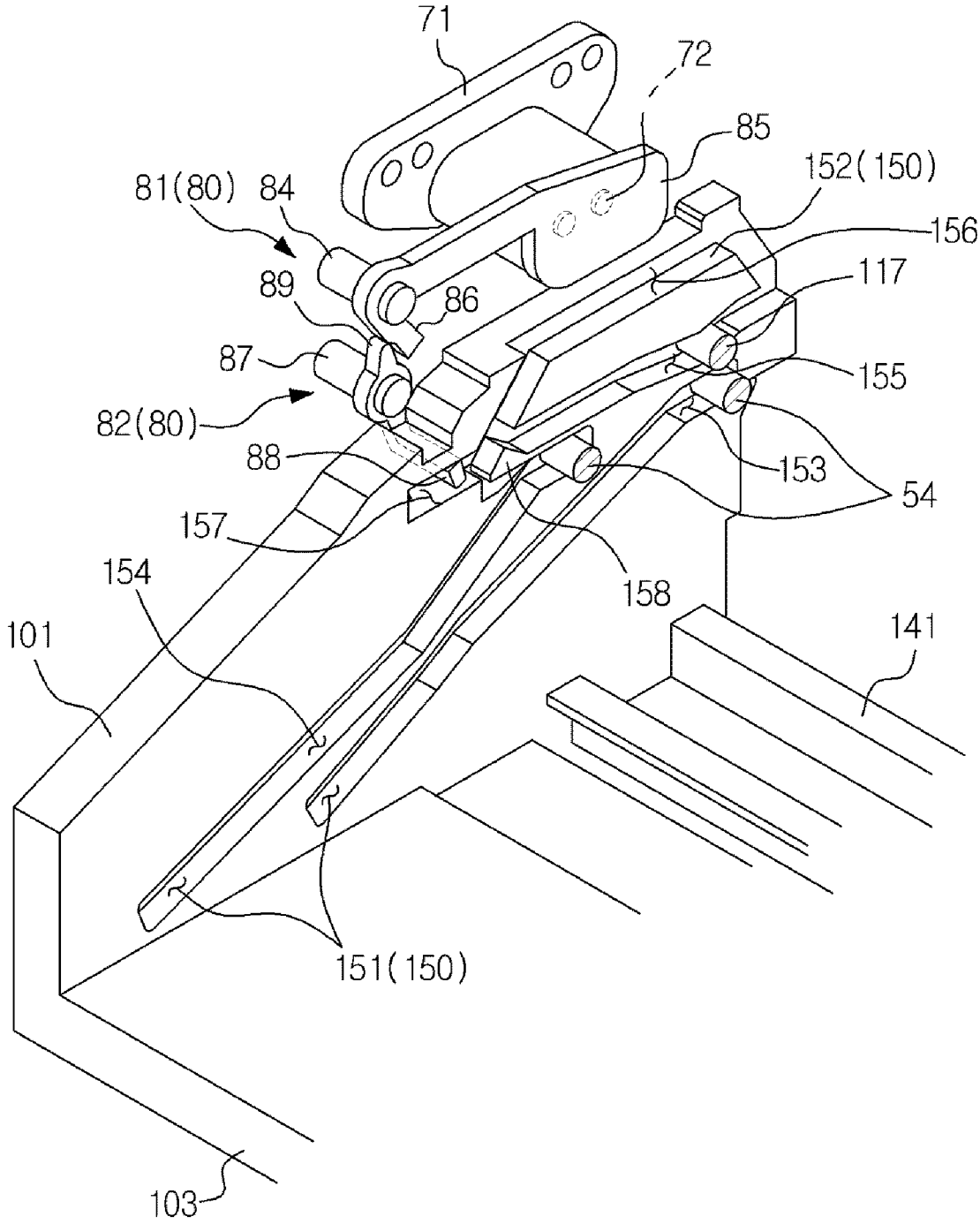
FIG. 8 is a view illustrating a first sidewall of a maintenance frame provided in an inkjet image forming apparatus in accordance with an embodiment of the present general inventive concept.
Figure 9:
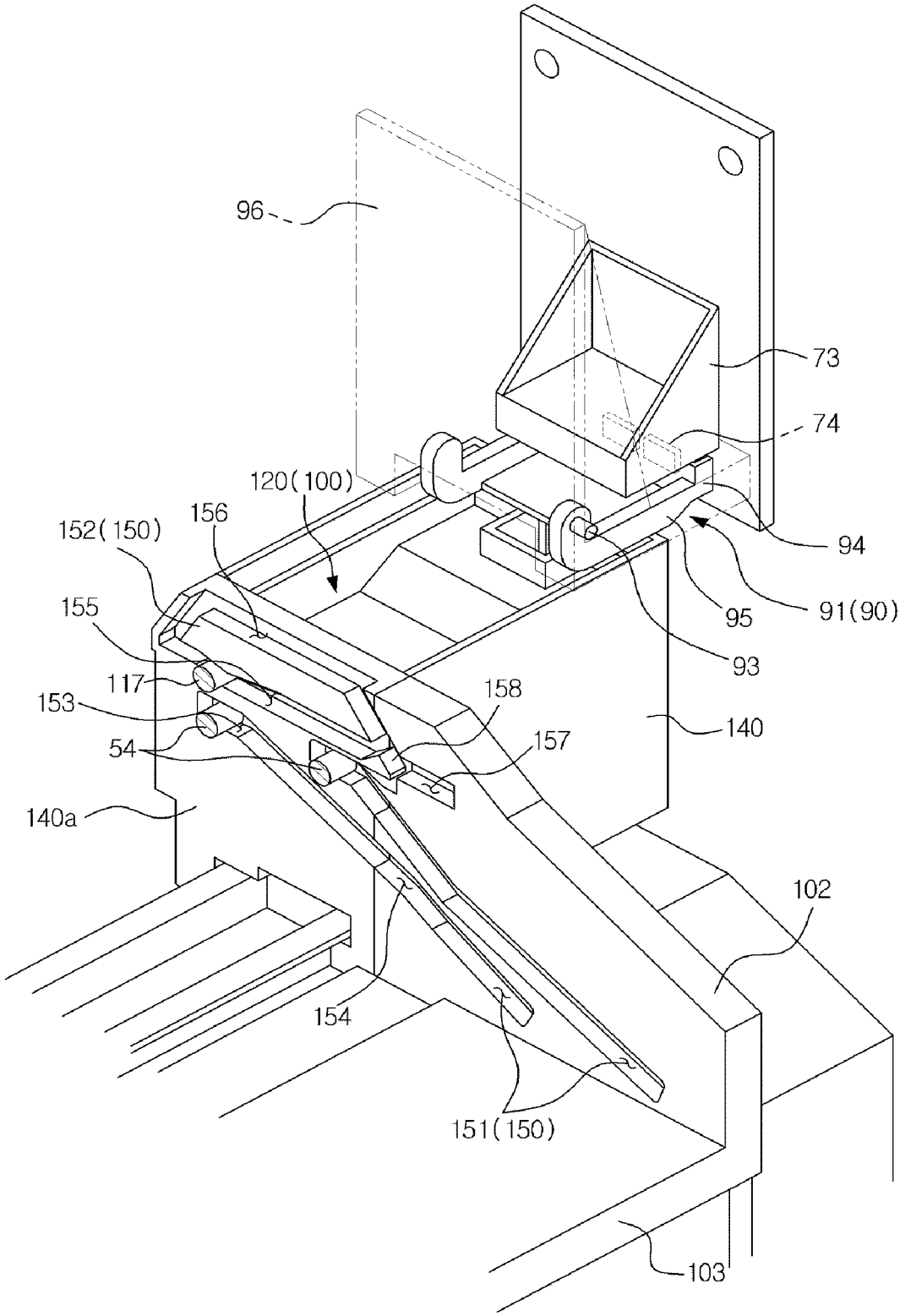
FIG. 9 is a view illustrating a second sidewall of a maintenance frame provided in the inkjet image forming apparatus in accordance with an embodiment of the present general inventive concept.

To solve the above problem, the inkjet image forming apparatus 1 in accordance with an embodiment of the present general inventive concept further includes protecting devices 80 (FIGS. 8) and 90 (FIG. 9). The protecting devices 80 and 90 shield the light emitting elements 73 and the light receiving elements 74 from the ink ejecting region, to protect the light emitting elements 73 and the light receiving elements 74 from the scattered ink or paper dust. Although the protecting devices 80 and 90 may be operated by a separate drive source such as a motor, in the embodiment of the present general inventive concept, the protecting devices 80 and 90 are operated in linkage with the maintenance device 100. The term "linkage" will take its plain and ordinary meaning, thereby being definable as "united" or "in unification with." Here, the maintenance device 100 includes a wiping unit 110 to wipe the nozzle portion 31 of the inkjet head 30 and a cleaning unit 120 to clean the nozzle portion 31 while moving in a longitudinal direction of the inkjet head 30.

Referring to FIGS. 1 and 5, the platen 50 moves between a printing position where the platen 50 opposes the nozzle portion 31 of the inkjet head 30 to support the printing medium M being transferred (See FIG. 1), and a maintenance position where the platen 50 is spaced apart from the nozzle portion 31 to expose a bottom of the nozzle portion 31 so as to enable a maintenance operation of the inkjet head 30 (See FIG. 5).

Referring to FIGS. 3 and 4, the platen 50 is connected with a platen drive shaft 104 via first linkages 51. The platen drive shaft 104 is inserted between the first sidewall 101 and the second sidewall 102. One end of the platen drive shaft 104 is coupled to a platen drive gear 109 and in turn, the platen drive gear 109 is rotated by a platen drive motor 108. Each first linkage 51 includes a first lever 106 to be rotated along with the platen drive shaft 104, and a second lever 107 having one end rotatably coupled to an end of the first lever 106. The other end of the second lever 107 is rotatably inserted into a first insertion hole 51 of the platen 50. With this configuration, if the platen drive gear 109 is rotated forward or reverse by the platen drive motor 108, the platen drive shaft 104 is rotated along with the platen drive gear 109, causing the platen 50, connected with the platen drive shaft 104 via the first linkages 51, to move from the printing position to the maintenance position or vice versa.

The wiping unit 110 is connected with the platen 50 via a second linkage 111. The wiping unit 110 includes a wiping body 113, to which a wiper 112 to wipe the nozzles 33 from the bottom of the inkjet head 30 is mounted. The wiper 112 may include a wiper roller and/or a wiper blade. The wiper roller may be made of an ink absorbing material such as sponge, and the wiper blade is made of an elastic material such as rubber. The second linkage 111 includes a pair of supporting arms 114 formed at the wiper body 113, and a pair of link arms 115 rotatably connected to ends of the pair of supporting arms 114, respectively. The pair of link arms 115 is rotatably inserted into second insertion holes 52 of the platen 50, and may be connected to each other by a connecting member 116.

The wiping unit 110 is moved in linkage with a movement of the platen 50 by the second linkage 111. The wiping unit 110 is located below the platen 50 when the platen 50 is at the printing position as illustrated in FIG. 1, but is moved downward along with the platen 50 as the platen 50 is moved to the maintenance position as illustrated in FIG. 5. Also, when the platen 50 is returned from the maintenance position to the printing position, the wiping unit 110 wipes the nozzle portion 31 of the inkjet head 30 as illustrated in FIG. 6. Here, when the wiping unit 110 is moved downward along with the platen 50 as illustrated in FIG. 5, this is referred to as a first ready position. When the wiping unit 110 is located below the platen 50 as illustrated in FIG. 1, this is referred to as a second ready position. The protecting device 80 is operated in linkage with the wiping unit 110 when the wiping unit 110 is moved from the second ready position to the first ready position and this will be described in detail hereinafter.

Figure 7:
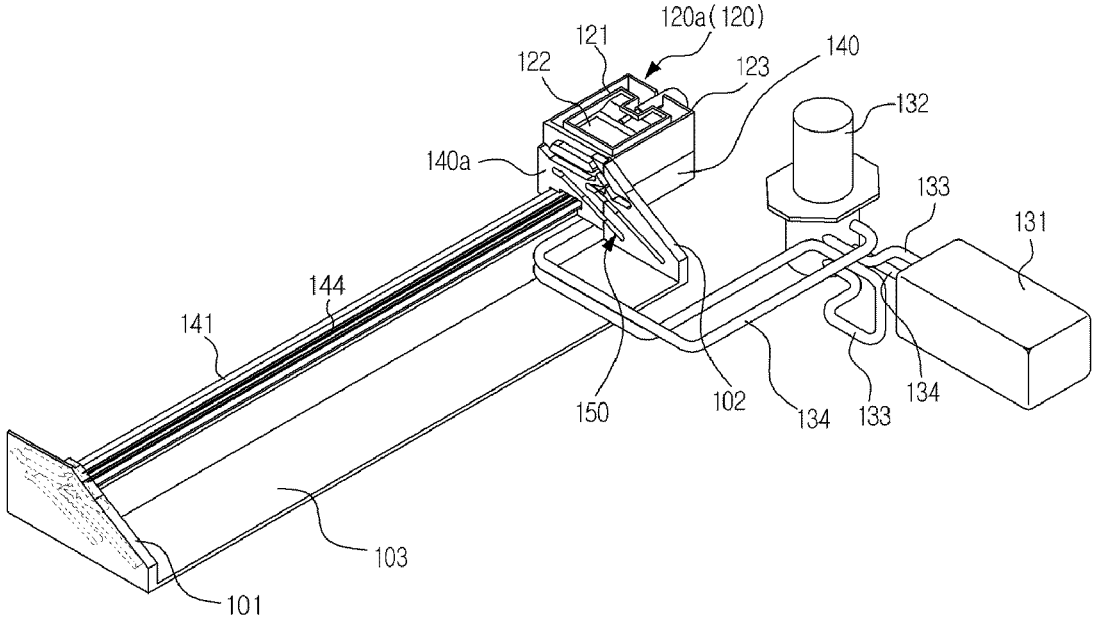
FIG. 7 is a perspective view illustrating a maintenance frame, a cleaning unit, a carriage, a storage tank, and a pump provided in an inkjet image forming apparatus in accordance with an embodiment of the present general inventive concept.

FIG. 7 is a perspective view illustrating the maintenance frame, the cleaning unit, a carriage, a storage tank, and a pump provided in the inkjet image forming apparatus in accordance with an embodiment of the present general inventive concept.

As illustrated in FIG. 7, the cleaning unit 120 serves to clean the nozzle portion 31 while moving in the longitudinal direction of the inkjet head 30 below the inkjet head 30. In the embodiment of the present general inventive concept, the cleaning unit 120 includes a washing basin 121 in which an ultrasonic oscillator 122 is mounted, and an ultrasonic washer 120*a* having an outer basin 123 surrounding the washing basin 121. Of course, the cleaning unit 120 is not limited to the ultrasonic washer 120*a*. Alternatively, the cleaning unit 120 may be a suction device, which is movable in the longitudinal direction of the inkjet head 30 and is used to clean the nozzle portion 31 of the inkjet head 30 via suction.

In the case of the cleaning unit 120 including the ultrasonic washer 120*a*, the inkjet image forming apparatus 1 further includes a storage tank 131 in which wash liquid is stored, and a pump 132 to circulate the wash liquid. During a cleaning operation of the ultrasonic washer 120*a*, the wash liquid stored in the storage tank 131 is pumped by the pump 132, so as to be fed into the washing basin 121 via a wash liquid feeding pipe 133. Once the wash liquid is fed into the washing basin 121, the ultrasonic oscillator 122 oscillates to produce water columns on a surface of the wash liquid. Thereby, the nozzle portion 31 can be washed by the water columns produced in the washing basin 121 as the ultrasonic washer 120*a* is moved in the longitudinal direction of the inkjet head 30. While the ultrasonic washer 120*a* washes the inkjet head 30, new wash liquid is continuously fed into the washing basin 121. If the wash liquid overflows the washing basin 121, the overflowed wash liquid is first received in the outer basin 123 surrounding the washing basin 121 and then, is collected in the storage tank 131 via a wash liquid collecting pipe 134 connected to the outer basin 123.

As illustrated in FIGS. 3 and 7, the ultrasonic washer 120*a* is mounted in a carriage 140, which is movable in the longitudinal direction of the inkjet head 30. The inkjet image forming apparatus 1 in accordance with an embodiment of the present general inventive concept includes a carriage shaft 141 to guide movement of the carriage 140, and a carriage drive mechanism to move the carriage 140 along the carriage shaft 141. The carriage drive mechanism includes a carriage drive motor 142, a gear 143 to transmit power of the carriage drive motor 142, and a carriage drive belt 144 engaged with the gear 143 so as to be circulated by the gear 143, the carriage drive belt 144 serving to transmit power of the carriage drive motor 142 to the carriage 140. The carriage 140 is affixed to the carriage drive belt 144 and is moved along with the carriage drive belt 144 being circulated.

The carriage 140, as illustrated in FIGS. 3 and 7, is arranged, at a carriage ready position, such that a side surface 140*a* of the carriage 140 is aligned with the second sidewall 102 of the maintenance frame 103, and the ultrasonic washer 120*a* is moved below the nozzle portion 31 to wash the nozzle portion 31. As the carriage 140 is moved to below the nozzle portion 31 from the carriage ready position, the carriage 140 is free from intervention by the protecting device 90 (FIG. 9). The carriage 140 is again interfered with the protecting device 90 when the carriage 140 is returned to the carriage ready position. This will be described in detail hereinafter.

As illustrated in FIGS. 1, 3 and 4, first guide protrusions 54 are provided at both sides of the platen 50, and second guide protrusions 117 are provided at both sides of the wiping unit 110. The first guide protrusions 54 and the second guide protrusions 117 are inserted into guide-ways 150 (See FIGS. 8 and 9) to guide movement of the platen 50 and the wiping unit 110.

FIGS. 8 and 9 are views, respectively, illustrating the first sidewall and the second sidewall of the maintenance frame provided in the inkjet image forming apparatus in accordance with an embodiment of the present general inventive concept.

As illustrated in FIGS. 8 and 9, the first guide protrusions 54 and the second guide protrusions 117 are inserted into the guide-ways 150 to guide movement of the platen 50 and the wiping unit 110. Of the guide-ways 150, ones to guide movement of the platen 50 are referred to as first guide-ways 151, and the others to guide movement of the wiping unit 110 are referred to as second guide-ways 152. The guide-ways 150, as illustrated in FIG. 8, are defined in the first sidewall 101 of the maintenance frame 103 and are also defined in the second sidewall 102 of the maintenance frame 103 and the side surface 140*a* of the carriage 140 as illustrated in FIG. 9. In particular, as illustrated in FIG. 9, by providing the side surface 140*a* of the carriage 140 with a portion of the guide-ways 150, an installation position of the carriage 140 can be determined in consideration of operation of the carriage 140 and also, a compact configuration to guide the platen 50 and the wiping unit 110 can be realized. Referring to FIGS. 8 and 9, the guide-ways 150 illustrated in FIG. 9 are identical to the guide-ways 150 illustrated in FIG. 8 except for the fact that the guide-ways 150 illustrated in FIG. 9 are divided into two portions, which are defined, respectively, in the second sidewall 102 of the maintenance frame 103 and the side surface 140*a* of the carriage 140. Therefore, the following description focuses upon the guide-ways 150 defined in both the second sidewall 102 of the maintenance frame 103 and the side surface 140*a* of the carriage 140.

As illustrated in FIG. 9, when the carriage 140 is at the carriage ready position, the guide-ways 150 defined in the side surface 140*a* of the carriage 140 are aligned with the guide-ways 150 defined in the second sidewall 102 of the maintenance frame 103, to guide movement of the platen 50 and the wiping unit 110.

Each first guide-way 151 to guide movement of the platen 50 includes a horizontal section 153 and an inclined section 154 inclined downward from the horizontal section 153. The first guide protrusion 54 is located in the horizontal section 153 when the platen 50 is at the printing position, and is guided along the inclined section 154 as the platen 50 is moved to the maintenance position.

Each second guide-way 152 to guide movement of the wiping unit 110 includes a moving section 155 and a wiping section 156. The moving section 155 guides the wiping unit 110, to prevent the wiper 112 from coming into contact with the nozzle portion 31 when the platen 50 is moved from the printing position to the maintenance position. The wiping section 156 guides the wiping unit 110, to allow the wiper 112 to come into contact with the nozzle portion 31 when the platen 50 is moved from the maintenance position to the printing position. An elastic arm 158 is disposed at a convergence point of the moving section 155 and the wiping section 156. The elastic arm 158 serves as a latch to prevent the second guide protrusion 117 from entering the moving section 155 when the platen 50 is moved from the maintenance position to the printing position. The elastic arm 158 also serves to allow the second guide protrusion 117 to enter the wiping section 156 by passing through the moving section 155 when the platen 50 is moved from the printing position to the maintenance position.

As illustrated in FIG. 8, the light emitting unit 71 is disposed outside the first sidewall 101 of the maintenance frame 103, and the protecting device 80 (hereinafter, referred to as a first protecting device) is provided near the light emitting unit 71.

The first protecting device 80 includes a first protecting member 81. The first protecting member 81 includes a first pivot shaft 84 rotatably supported by a not illustrated frame, a first shutter 85 extending from the first pivot shaft 84 to inner ends of the light emitting elements 72, and an operating arm 86 extending from the first pivot shaft 84 toward a lever 82. The first protecting device 80 further includes the lever 82 to transmits power to the first pivot shaft 84. The lever 82 includes a lever pivot shaft 87 rotatably supported by the first sidewall 101, a first lever arm 88 extending downward from the lever pivot shaft 87, and a second lever arm 89 extending from the lever pivot shaft 87 toward the operating arm 86. Here, the operating arm 86 and the second lever arm 89 are arranged to interfere with each other. When the first shutter 85 is located close to the light emitting elements 72 to cover and protect the light emitting elements 72, this position is referred to as a first position.

As illustrated in FIG. 9, the carriage 140 is aligned with the second sidewall 102 of the maintenance frame 103. The light receiving unit 73 is disposed outside the carriage 140 and the protecting device 90 (hereinafter, referred to as a second protecting device) is provided near the light receiving unit 73.

The second protecting device 90 includes a second protecting member 91. The second protecting member 91 includes a pair of extending arms 95 arranged parallel to each other with a certain space therebetween, second pivot shafts 93 provided at inner ends of the arms 95 to pivotally rotatably support a supporting frame 96 provided adjacent to the light receiving unit 73, and a second shutter 94 formed at outer ends of the extending arms 95. Here, the extending arms 95 and the carriage 140 are arranged to interfere with each other. When the second shutter 94 is located close to the light receiving elements 74 to protect the light receiving elements 74, this position is referred to as the first position.

Figure 10:
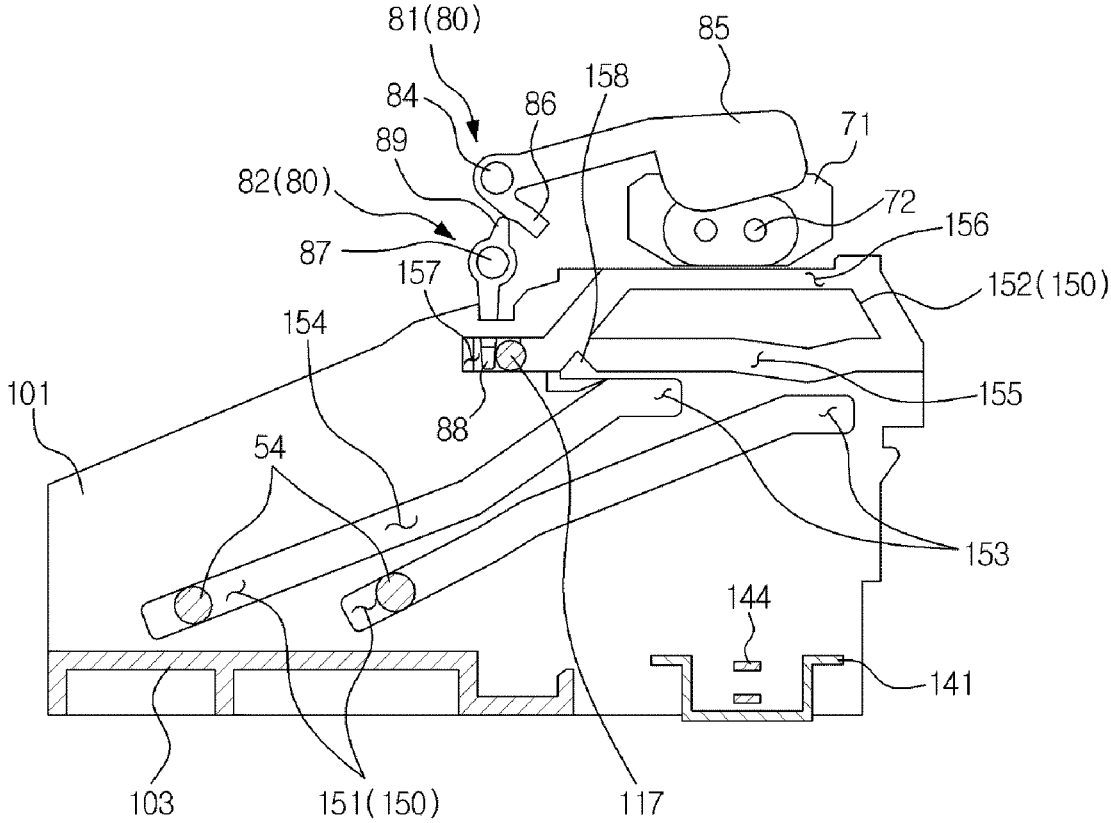
FIG. 10 is a sectional view illustrating a first sidewall of a maintenance frame provided in an inkjet image forming apparatus in accordance with an embodiment of the present general inventive concept, in a state wherein a platen is at a maintenance position.

FIG. 10 is a sectional view illustrating the first sidewall of the maintenance frame provided in the inkjet image forming apparatus in accordance with the embodiment of the present general inventive concept, in a state wherein the platen is at the maintenance position.

Referring to FIGS. 8 and 10, when the platen 50 is at the printing position as illustrated in FIG. 1, the first guide protrusions 54 of the platen 50 are located in the horizontal sections 153 of the first guide-ways 151, and the second guide protrusion 117 of the wiping unit 110 is located in the moving section 155 of the second guide-way 152. The position where the second guide protrusion 117 is located in the moving section 155 is referred to as the second ready position.

The first lever arm 88 of the lever 82 provided in the first protecting device 80 is located in a linkage section 157 of the second guide-way 152. No force acts on the first lever arm 88 while the second guide protrusion 117 is at the second ready position and therefore, the first protecting member 81 is located at the first position by the weight thereof. Here, the first position is the above-described position where the first shutter 85 is located close to the inner ends of the light emitting elements 72. With this arrangement, the first shutter 85 shields the light emitting elements 72 from the ink ejecting region 34 (See FIG. 1), to protect the light emitting elements 72.

Alternatively, when the platen 50 is at the maintenance position, as illustrated in FIG. 10, the first guide protrusions 54 of the platen 50 are located in the inclined sections 154 of the first guide-ways 151, and the second guide protrusion 117 of the wiping unit 110 is located in the linkage section 157 of the second guide-way 152. The position where the second guide protrusion 117 is located in the linkage section 157 as illustrated in FIG. 10 is referred to as the first ready position.

The first lever arm 88 is located in the linkage section 157 of the second guide-way 152 and therefore, is interfered with the second guide protrusion 117. The second guide protrusion 117 comes into close contact with the first lever arm 88, rotating the lever pivot shaft 87 clockwise. Also, the second lever arm 89 comes into close contact with the operating arm 86, rotating the first pivot shaft 84 counterclockwise. Thereby, the first shutter 85 is spaced apart from the light emitting elements 72 and thus, the light emitting elements 72 are exposed to the ink ejecting region 34. The position where the first shutter 85 is spaced apart from the light emitting elements 72 and does not protect the light emitting elements 72 any longer is referred to as a second position.

Consequently, when the wiping unit 110 is at the second ready position (i.e. the second guide protrusion 117 is located in the moving section 155), the first protecting member 81 is located at the first position, allowing the first shutter 85 to shield the light emitting elements 72. Thereafter, the wiping unit 110 is at the first ready position (or the second guide protrusion 117 is located in the linkage section 157), the first protecting member 81 is located at the second position, causing the first shutter 85 to be spaced apart from the light emitting elements 72. In this way, the first protecting device 80 is operated in linkage with the wiping unit 110.

Figure 11:
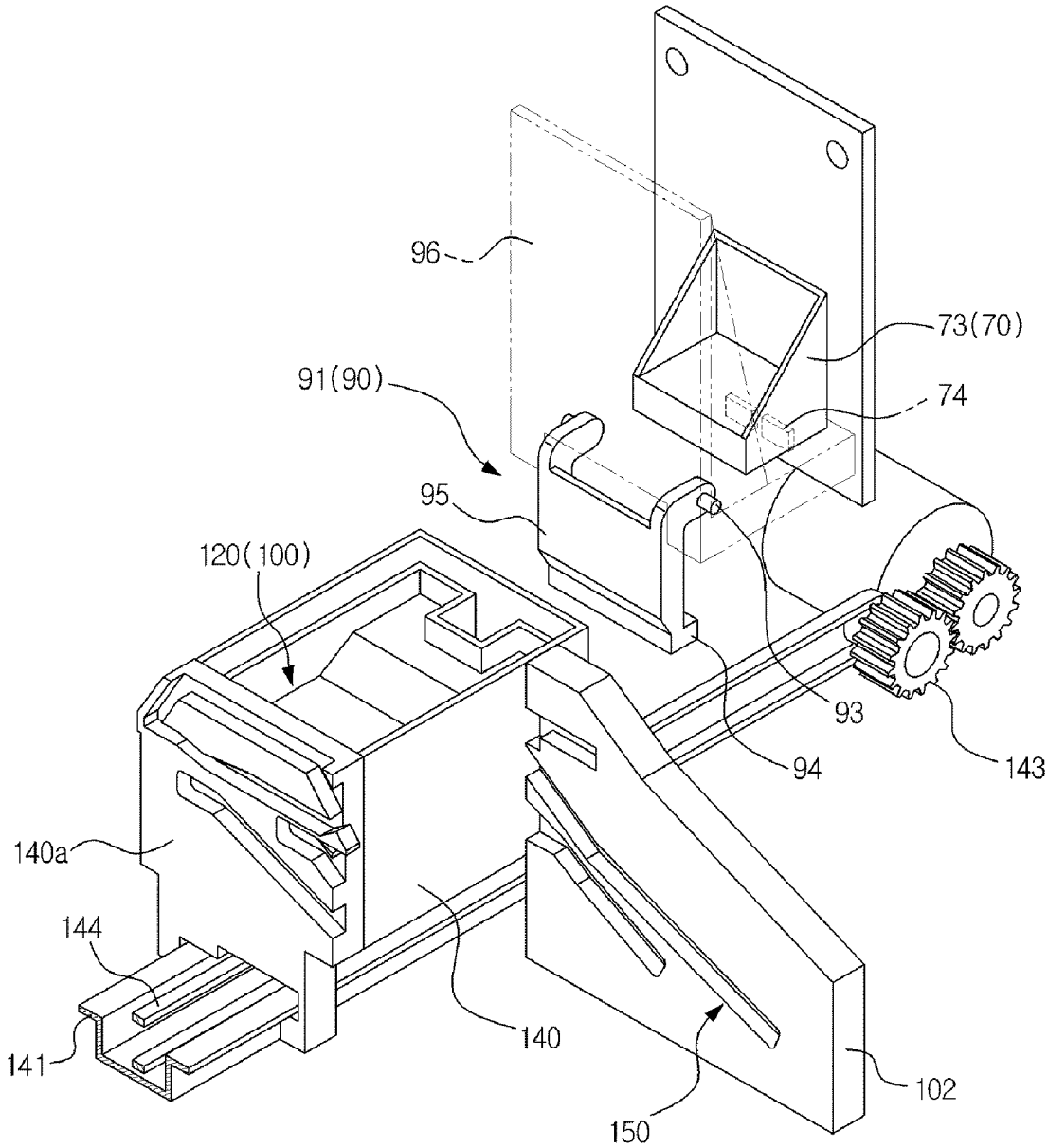
FIG. 11 is a view illustrating a second protecting device provided in an inkjet image forming apparatus in accordance with an embodiment of the present general inventive concept, in a state wherein a carriage undergoes position displacement.

FIG. 11 is a view illustrating the second protecting device provided in the inkjet image forming apparatus in accordance with an embodiment of the present general inventive concept, in a state wherein the carriage undergoes position displacement.

Referring to FIGS. 9 and 11, the carriage 140, as illustrated in FIG. 9, comes into close contact with the extending arms 95 of the second protecting device 90 such that the second shutter 94 is located close to the light receiving elements 74. The position where the second shutter 94 shields the light receiving elements 74 from the ink ejecting region 34 so as to protect the light receiving elements 74 is referred to as the first position.

Thereafter, if the carriage 140 is moved as illustrated in FIG. 11 to thereby be free from intervention by the extending arms 95, the second shutter 94 is spaced apart from the light receiving elements 74 to expose the light receiving elements 74 to the ink ejecting region 34. The position of the second protecting member 91 where the second shutter 94 is spaced apart from the light receiving elements 74 so as not to protect the light receiving elements 74 is referred to as the second position.

Consequently, when the carriage 140 is aligned with the second sidewall 102 (i.e. the carriage 140 is at the carriage ready position), the second protecting member 91 is located at the first position, allowing the second shutter 94 to shield the light receiving elements 74. Thereafter, when the carriage 140 is moved as illustrated in FIG. 11, the second protecting member 91 is located at the second position, causing the second shutter 94 to be spaced apart from the light receiving elements 74. In this way, the second protecting device 90 is operated in linkage with the carriage 140.

Through operation of the first protecting device 80 in linkage with the wiping unit 110, the light emitting elements 72 are protected when the platen 50 is at the printing position, and are unprotected when the platen 50 is at the maintenance position. Thereby, at the maintenance position of the platen 50, the light emitting elements 72 irradiate light through ink droplets to detect ink ejection failure.

In addition, through operation of the second protecting device 90 in linkage with the carriage 140, the light receiving elements 74 are protected when the platen 50 is at the printing position, and are unprotected when the platen 50 is at the maintenance position and the carriage 140 is moved to below the nozzle portion 31. Thereby, when the carriage 140 is located below the nozzle portion 31, the light receiving elements 74 can detect the light irradiated from the light emitting elements 72, detecting ink ejection failure.

As apparent from the above description, the present general inventive concept provides an inkjet image forming apparatus, which includes protecting devices to prevent contamination of, for example, optical elements (or optical sensors) used to sense ejection of ink.

Further, according to the present general inventive concept, a desired performance of an ink sensing device can be achieved and consequently, the inkjet image forming apparatus can achieve high operating reliability.

Furthermore, according to the present general inventive concept, the protecting devices can be operated in linkage with a maintenance device without a separate drive source, resulting in a simplified configuration thereof.

Although various embodiments of the present general inventive concept have been illustrated and described, it would be appreciated by those skilled in the art that changes may be made in this embodiment without departing from the principles and spirit of the general inventive concept, the scope of which is defined in the claims and their equivalents.

What is claimed is:

1. An inkjet image forming apparatus, comprising:

an inkjet head having a nozzle portion formed with ink ejecting nozzles;

an ink sensing device to sense ink ejected from the nozzles;

a maintenance device to perform an operation of maintaining the nozzle portion in a normal condition; and at least one protecting device having a protecting member to protect the ink sensing device from impurities at a first position and to release the ink sensing device from protection at a second position, the protecting member being operated in linkage with the maintenance device to be moved between the first position and the second position.

2. The apparatus according to claim 1, wherein the maintenance device includes a wiping unit to be moved below the nozzle portion in a direction crossing the nozzle portion, so as to wipe the nozzle portion.

3. The apparatus according to claim 2, wherein the protecting member is operated in linkage with the wiping unit, to be moved between the first position and the second position.

4. The apparatus according to claim 1, wherein the maintenance device includes a carriage to be moved along the nozzle portion below the nozzle portion.

5. The apparatus according to claim 4, wherein the protecting member is operated in linkage with the carriage, to be moved between the first position and the second position.

6. The apparatus according to claim 1, wherein the maintenance device includes a wiping unit to be moved below the nozzle portion in a direction crossing the nozzle portion so as to wipe the nozzle portion, and a carriage to be moved along the nozzle portion below the nozzle portion, the carriage incorporating a cleaning unit to clean the nozzle portion.

7. The apparatus according to claim 6, wherein the at least one protecting device includes a first protecting device to be operated in linkage with the wiping unit, and a second protecting device to be operated in linkage with the carriage.

8. The apparatus according to claim 1, further comprising:

a platen having a printing position where the platen opposes the nozzle portion and supports a printing medium, and a maintenance position where the platen is moved from the printing position to expose the bottom of the nozzle portion.

9. The apparatus according to claim 8, wherein the maintenance device is operated in linkage with the platen, and the protecting device is operated in linkage with the maintenance device.

10. The apparatus according to claim 3, wherein:

the protecting member includes a first pivot shaft, and a shutter and an operating arm extending in different directions from the first pivot shaft;

the operating arm is operated in linkage with the wiping unit according to a position of the wiping unit, so as to rotate the first pivot shaft; and the shutter is moved between the first position and the second position according to rotation of the first pivot shaft.

11. The apparatus according to claim 10, wherein:

the protecting device further includes a lever disposed between the wiping unit and the protecting member; and the lever includes a lever pivot shaft, a first lever arm extending from the lever pivot shaft toward the wiping unit and having one end located at a position to be interfered with the wiping unit, and a second lever arm extending from the lever pivot shaft toward the protecting member and having one end located at a position to be interfered with the operating arm of the protecting member.

12. The apparatus according to claim 11, wherein:

the maintenance device further includes a maintenance frame having a guide-way to guide movement of the wiping unit;

the wiping unit includes a guide protrusion to be inserted into the guide-way; and the one end of the first lever arm is disposed in the guide-way so as to be interfered with the guide protrusion.

13. The apparatus according to claim 5, wherein:

the protecting member includes a second pivot shaft, an extending arm extending from the second pivot shaft and located at a position to be interfered with the carriage, and a shutter provided at an end of the extending arm;

the extending arm is interfered with the carriage according to a position of the carriage, so as to rotate the second pivot shaft; and the shutter is moved between the first position and the second position according to rotation of the second pivot shaft.

14. The apparatus according to claim 1, wherein:

the ink sensing device includes a light emitting unit to emit light to a region below the nozzle portion, and a light receiving unit to receive the light having passed through the region below the nozzle portion; and the at least one protecting device includes a first protecting device corresponding to the light emitting unit, and a second protecting device corresponding to the light receiving unit.

15. An inkjet image forming apparatus, comprising:

an inkjet head including a nozzle portion having a length at least greater than a width of a printable printing medium;

a light emitting unit having a light emitting element to emit light to an ink ejecting region provided below the nozzle portion;

a light receiving unit having a light receiving element to receive the light having passed through the ink ejecting region;

a maintenance device to perform an operation of maintaining the nozzle portion in a normal condition while being moved between a first ready position and a second ready position; and a first protecting device having a first protecting member disposed to shield one of the light emitting element and the light receiving element from the ink ejecting region, wherein the first protecting member is operated in linkage with movement of the maintenance device, so as to expose the one of the light emitting element and the light receiving element to the ink ejecting region.

16. The apparatus according to claim 15, wherein the maintenance device includes a wiping unit to be moved below the nozzle portion in a direction crossing the nozzle portion, so as to wipe the nozzle portion.

17. The apparatus according to claim 16, wherein the first protecting member exposes the one of the light emitting element and the light receiving element to the ink ejecting region when the wiping unit is at the first ready position.

18. The apparatus according to claim 16, wherein the first protecting member includes a first pivot shaft, an operating arm connected to the first pivot shaft and operated in linkage with the wiping unit, and a shutter connected to the first pivot shaft and used to shield or expose the one of the light emitting element and the light receiving element according to movement of the operating arm.

19. The apparatus according to claim 16, wherein the first protecting device further includes a lever disposed between the wiping unit and the first protecting member, the lever being operated in linkage with the wiping unit so as to move the first protecting member.

20. The apparatus according to claim 16, further comprising:

a second protecting device having a second protecting member disposed to shield the other one of the light emitting element and the light receiving element from the ink ejecting region, wherein the maintenance device further includes a carriage to be movable in a longitudinal direction of the nozzle portion, and wherein the second protecting member is operated in linkage with the carriage, so as to expose the other one of the light emitting element and the light receiving element to the ink ejecting region.

21. The apparatus according to claim 20, wherein the second protecting member includes a second pivot shaft, an extending arm extending from the second pivot shaft and located at a position to be interfered with the carriage, and a shutter to shield or expose the other one of the light emitting element and the light receiving element according to movement of the extending arm.

22. The apparatus according to claim 20, wherein the carriage includes a guide-way to guide movement of the wiping unit.

23. The apparatus according to claim 22, wherein the second protecting member exposes the other one of the light emitting element and the light receiving element to the ink ejecting region as the carriage is moved away from the second protecting member after guiding the wiping unit.

24. The apparatus according to claim 20, wherein a cleaning unit to clean the nozzle portion is mounted in the carriage.

25. An inkjet image forming apparatus, comprising:

an inkjet head including a nozzle portion having a length at least greater than a width of a printable printing medium;

a light emitting unit having a light emitting element to emit light to an ink ejecting region provided below the nozzle portion;

a light receiving unit having a light receiving element to receive the light having passed through the ink ejecting region;

a first maintenance unit be moved below the nozzle portion in a direction crossing the nozzle portion, so as to perform a maintenance operation for the nozzle portion;

a carriage disposed to be movable in a longitudinal direction of the nozzle portion and incorporating a second maintenance unit to perform a maintenance operation for the nozzle portion;

a first shutter to be operated in linkage with movement of the first maintenance unit, so as to shield or expose one of the light emitting element and the light receiving element from or to the ink ejecting region; and a second shutter to be operated in linkage with movement of the carriage, so as to shield or expose the other one of the light emitting element and the light receiving element from or to the ink ejecting region.

26. An inkjet image forming apparatus, comprising:

an inkjet head to eject ink;

a maintenance device to maintain the inkjet head to eject the ink in a maintenance position;

an ink sensing device to sense ink ejected from the inkjet head;

one or more protecting devices to protect the ink sensing device from contaminants in a protecting position; and a linkage coupled to the maintenance device to move the maintenance device to the maintenance position and the one or more protecting devices to the protecting position.

* * * * *